US006172697B1

(12) United States Patent
Lee

(10) Patent No.: US 6,172,697 B1
(45) **Date of Patent: *Jan. 9, 2001**

(54) METHOD AND APPARATUS FOR DETECTING THE LEVEL OF TONER USING A PHOTOSENSOR

(75) Inventor: Bong-Gi Lee, Kyonggi-do (KR)

(73) Assignee: SamSung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/855,572

(22) Filed: May 13, 1997

(30) Foreign Application Priority Data

May 15, 1996 (KR) ..... 96/16063

(51) Int. Cl.[7] ..... B41J 2/39; B41J 2/395; B41J 2/40; G03G 15/10

(52) U.S. Cl. ..... 347/158; 399/61

(58) Field of Search ..... 347/104, 101, 347/84, 85, 112, 118, 129, 158, 55; 399/95, 30, 57, 61, 27, 62, 64

(56) References Cited

U.S. PATENT DOCUMENTS 4,853,718 * 8/1989 ElHatem et al. .
5,068,806 * 11/1991 Gatten .
5,121,343 * 6/1992 Faris ..... 395/111
5,414,452 * 5/1995 Accatino et al. .
5,485,191 * 1/1996 Gu .
5,488,395 * 1/1996 Takayanagi et al. .
5,508,786 * 4/1996 Ogiri et al. .
5,574,484 * 11/1996 Cowger .
5,596,351 * 1/1997 Stapleton .
5,610,635 * 3/1997 Murray et al. .
5,617,121 * 4/1997 Tachihara et al. .

FOREIGN PATENT DOCUMENTS 703 080 A2 * 3/1996 (EP) ..... 347/55

* cited by examiner

*Primary Examiner*—John Barlow
*Assistant Examiner*—Raquel Yvette Gordon
(74) *Attorney, Agent, or Firm*—Robert E. Bushnell, Esq.

(57) ABSTRACT

A method for detecting the status of the toner in a laser printer uses a photosensor. The method includes sampling a signal generated from the photosensor during a specified time, increasing or decreasing the value of a counter in accordance with an integral algorithm, and comparing the resultant counter value with a reference value, and displaying the status of the toner in the printer on a display device, depending on a result of such comparison. This method can accommodate relatively inexpensive photosensors. As the noise-ridden signal generated by such a photosensor is effectively filtered, this method is advantageous in cost and reliability.

22 Claims, 6 Drawing Sheets

METHOD AND APPARATUS FOR DETECTING THE LEVEL OF TONER USING A PHOTOSENSOR

CLAIM OF PRIORITY

This application makes reference to, incorporates the same herein, and claims all benefits accruing under 35 U.S.C. §119 from an application for METHOD FOR DETECTING THE STATUS OF TONER USING A PHOTOSENSOR earlier filed in the Korean Industrial Property Office on the $15^{th}$ day of May 1996 and there duly assigned Serial No. 16063/1996, a copy of which application is annexed hereto.

BACKGROUND OF THE INVENTION

1. Field of the Invention

The present invention relates generally to a method for detecting the level of printing material in a printer, and more particularly to accurately detecting the status of toner in a laser printer by a more efficient use of a photosensor.

2. Description of the Prior Art

In general, exemplars of the contemporary practice of printers are frequently concerned with detecting the current level of printing material that is left in the printer. In particular, laser printers are provided with toner sensing apparatus for detecting the status of toner powder in those printers. Among exemplars of the contemporary practice, Tachihara et al. (U.S. Pat. No. 5,617,121, Ink Jet Recording With Ink Detection, Apr. 1, 1997) discusses a recording head that includes discharge ports for discharging ink. An ink detection element is provided in the liquid chamber for detecting the presence of ink. Murray et al. (U.S. Pat. No. 5,610,635, Printer Ink Cartridge With Memory Storage Capacity, Mar. 11, 1997) discusses a printer ink cartridge including a memory storage element. The memory storage element is capable of storing information regarding the amount of ink remaining in the cartridge. The memory storage element is connected to the control and driver circuit to enable information to be retrieved and stored from the memory storage element. The control and driver circuit can also include a counter for counting the number of times the heating elements on the cartridge are energized. The approximate number of times the heating elements have been energized indicates the approximate number of drops of ink that have been applied by the cartridge. Stapleton (U.S. Pat. No. 5,596,351, Ink Level Sensing On A Pen Carriage In A Pen Plotter, Jan. 21, 1997) discusses an apparatus for sensing whether a liquid with a turbulent surface and contained within a vessel has fallen to a level where the liquid is substantially expended. Cowger (U.S. Pat. No. 5,574,484, Level Detection For Ink Cartridges Of Ink-Jet Printers, Nov. 12, 1996) discusses a sensor that detects the level of ink present in an inksupply cartridge of an ink-jet type printer. The sensor moves with the reciprocating pen carriage of the printer. Ogiri et al. (U.S. Pat. No. 5,508,786, Image Forming Apparatus, Apr. 16, 1996) discusses determining the number of copies which can be outputted corresponding to the defined capacity of the developer. Takayanagi et al. (U.S. Pat. No. 5,488,395, Liquid Jet Recording Apparatus, Jan. 30, 1996) discusses a liquid jet recording apparatus having a pair of electrodes provided to be immersed in the ink in the container. By applying a voltage between the electrodes, the remainder of the ink is detected by a change in the electric resistance between the electrodes. Gu (U.S. Pat. No. 5,485,191, Image Forming Apparatus Having Tone Correction Function, Jan. 16, 1996) discusses an image forming apparatus including an electrophotographic photosensitive member. For tone controls, a detector detects a state of the tone control image, and the controller controls the electrostatic latent image forming device on the basis of a datum from the detector and predetermined tone correcting information. Accatino et al. (U.S. Pat. No. 5,414,452, Recognition Of Ink Expiry In An Ink Jet Printing Head, May 9, 1995) discusses ink jet printers in which the print head is connected to an ink reservoir, such as can be used in teleprinter or facsimile apparatuses. A logic circuit is used to count the number of drops gradually expelled, and with any necessary correction, compares this number with the maximum number of drops equivalent to a known volume of ink contained on average in the reservoir. Expiry of the ink is indicated as in dependence upon the result of the comparison. Gatten (U.S. Pat. No. 5,068,806, Method Of Determining Useful Life Of Cartridge For An Ink Jet Printer, Nov. 26, 1991) discusses a computer program in the microcontroller of an ink jet printer-plotter that counts the ink dots fired by the carriage of the printer. El Hatem et al. (U.S. Pat. No. 4,853,718, On Chip Conductive Fluid Sensing Circuit, Aug. 1, 1989) discusses a situation in which the ink in an ink jet is sensed by a capacitor, one plate of which is coupled to the ground through the ink. From my study of these exemplars of the contemporary practice and art, I find that there is a need for an effective and improved device for accurate toner detection that does not require an overly accurate (and hence expensive) photosensor.

SUMMARY OF THE INVENTION

Thus, an object of the present invention is to provide an improved method for detecting the level of printing material in a printer.

A further object of the present invention is to provide an improved method for accurately detecting the status or level of toner in a laser printer by a more efficient use of a photosensor.

Another object of the present invention is to provide a method for detecting the status or level of the toner in the developing device which is advantageous in costs and reliability.

To achieve these and other objects, a photosensor is employed to measure the amount of the toner in the developing device. This photosensor does not have to be apiezoelectric detector. Thus, it may be relatively inexpensive compared with a piezoelectric detector. The noise-ridden signal generated from such a photosensor is sampled in accordance with the integral algorithm and filtered to enable the presence or absence of the toner in the developing device to be detected with accuracy.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

15

DETAILED DESCRIPTION OF THE PREFERRED EMBODIMENT

Figure 1:
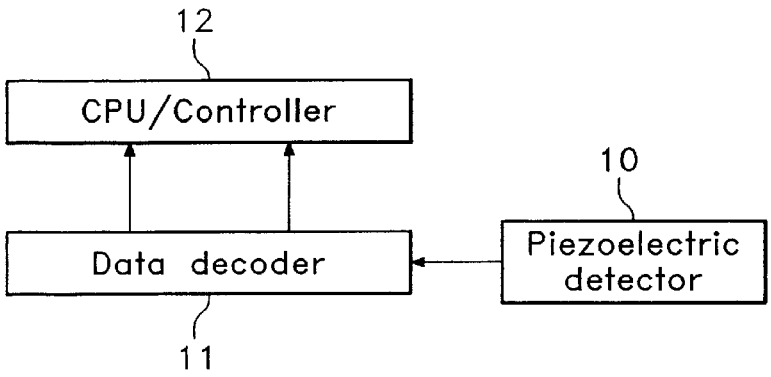
FIG. 1 is a schematic block diagram of a contemporary toner sensing apparatus.

Turning now to the drawings, specifically to FIG. 1, a contemporary toner sensing apparatus is schematically illustrated, wherein a piezoelectric detector 10 measures the weight of the toner powder in a developing device not shown and outputs the measured value as digital data. A data decoder 11 reads the digital data inputted from the piezoelectric detector 10. A CPU or controller 12 determines whether of the status of the toner in the developing device on the basis of the data inputted from the data decoder 11 and outputs the resultant of determination to a display device not shown.

Figure 2A:
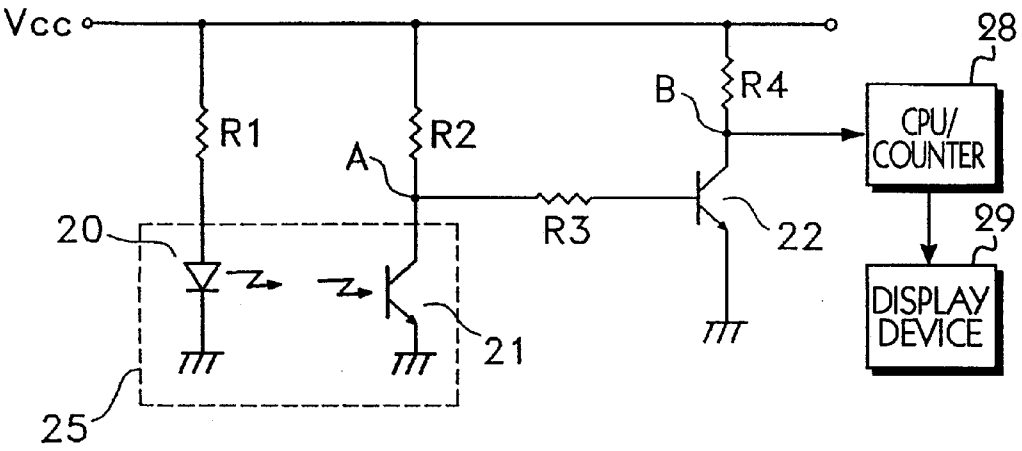
FIG. 2A shows a circuitry of another contemporary toner sensing apparatus employing a photosensor as can be used with a CPU/counter and a display device in the present invention.

FIG. 2A illustrates a circuitry of another toner sensing apparatus employing a photosensor 25. An anode of a photodiode is connected to a power source Vcc via a resistance R1 and its cathode is connected to ground. Another component of the photosensor can be a phototransistor 21 of which a base receives light from the photodiode 20, a collector terminal A is connected to the power source Vcc via a resistance R2 and an emitter is connected to ground. The photosensor can also include a transistor 22 of which a base is connected to the collector terminal A of the phototransistor 21 via a resistance R3, a collector terminal B is connected to the power source Vcc via a resistance R4 and an emitter is connected to ground. In this configuration, the photosensor 25 is composed of the photodiode 20 for emitting light and the phototransistor 21 for receiving the light from the photodiode 20 as shown in the dotted line in that view.

Figure 2B:
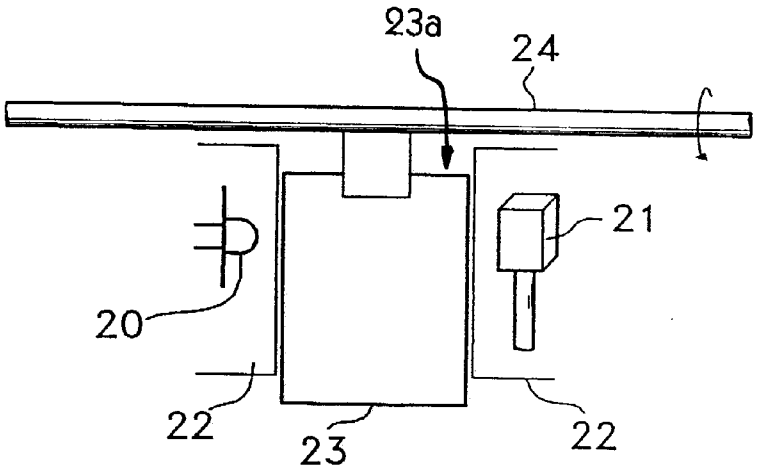
FIG. 2B depicts how the toner sensing apparatus of FIG. 2A is mounted in the developing device.

FIG. 2B shows how the toner sensing apparatus of FIG. 2A is mounted in the developing device. In arrangement, the photodiode 20 and the phototransistor 21 are in opposing relation with each other, having the developer such as toner powder therebetween in a toner container 23*a* two light transmitting films 22 made of transparent insulating material are provided to make isolation of the photodiode 20 and the phototransistor 21 from the toner having conductivity so as to prevent the two elements from being short-circuited by such toner. A toner removing blade 23 is fixed to a rotational shaft 24 and scrapes the toner powder adhered to the surfaces of the light transmitting films 22 as it rotates, so that the light from the photodiode 20 can be transmitted to the phototransistor 21 without interruption.

Hereinafter, such a toner sensing apparatus is described in more detail with reference to FIGS. 2A and 2B. In the developing device, the toner powder is provided between the photodiode 20 and the phototransistor 21 by a specified height in toner container 23*a* both being arranged to face with each other as mentioned before. The photodiode 20 can emit light since it is connected to the power source Vcc in forward direction and thus current flows therethrough all the time.

In such a set of devices, at least two situations can arise: one is when the toner is properly full enough in the developing device and the other is when the toner is short or empty.

First, in case of the former (enough toner), the toner in toner container 23*a* existing in the developing device by a specified height can block the light from the photodiode 20 to be transmitted to the base of the phototransistor 21. In this case, the phototransistor 21 is turned off and the collector terminal A outputs the signal of high level. This signal is then transmitted to the base of the transistor 22 through the resistance R3, so that the transistor 22 is turned on. Next, the signal is inversed and amplified at the last output terminal B of the toner sensing apparatus 3, resulting in low level.

In contrast, when the toner is nearly short or empty in the lather case (low/empty toner), it is possible that the light from the photodiode 20 is transmitted to the base of the phototransistor 21 with no problem, whereby the phototransistor 21 is turned on and the collector terminal A outputs the signal of low level. This signal is then transmitted to the base of the transistor 22 through the resistance R3 and the transistor 22 is turned on. As a result, the signal at the terminal B becomes high level.

Figure 2C:
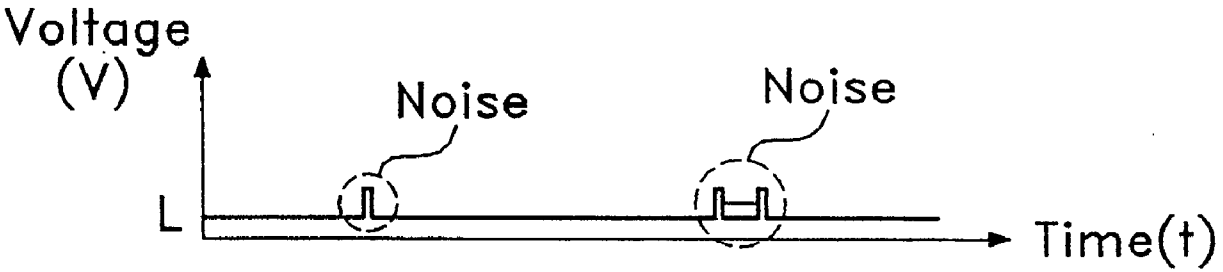
FIG. 2C shows a waveform of an output terminal B of the toner sensing device of FIG. 2A when the toner is properly enough or full in the developing device.
Figure 2D:
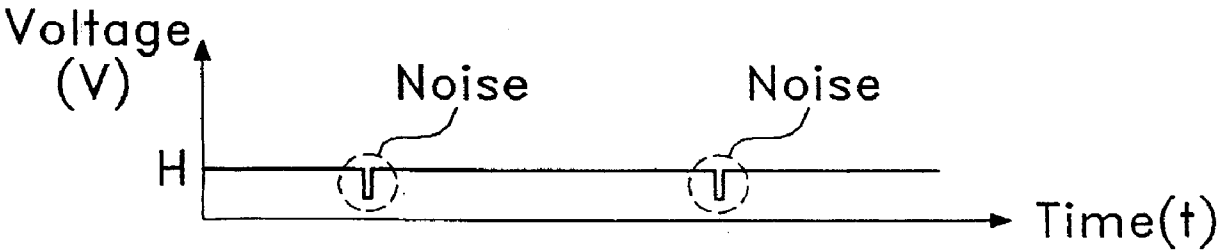
FIG. 2D shows a waveform of an output terminal B of the toner sensing device of FIG. 2A when the toner is short or empty in the developing device.

Thus, it is possible to judge the status or level of the toner in the developing device by means of the output signal of the terminal B in a manner that the low signal signifies that the toner is properly enough or full and the high signal signifies that the toner is short or empty. Nevertheless, this contemporary apparatus is disadvantageous in various aspects. The piezoelectric detector is very expensive and since replacement is limited to the same model of any specific manufacturer for the reliable operation, to buy such replacement may be not easy. For these reasons, the relatively cheaper photosensors have often been used instead of the piezoelectric detector. This can often bring problems in reliability because the toner removing blade or the like can make noise as shown in FIGS. 2C and 2D and filtering of such noise is also not easy.

Figure 3:
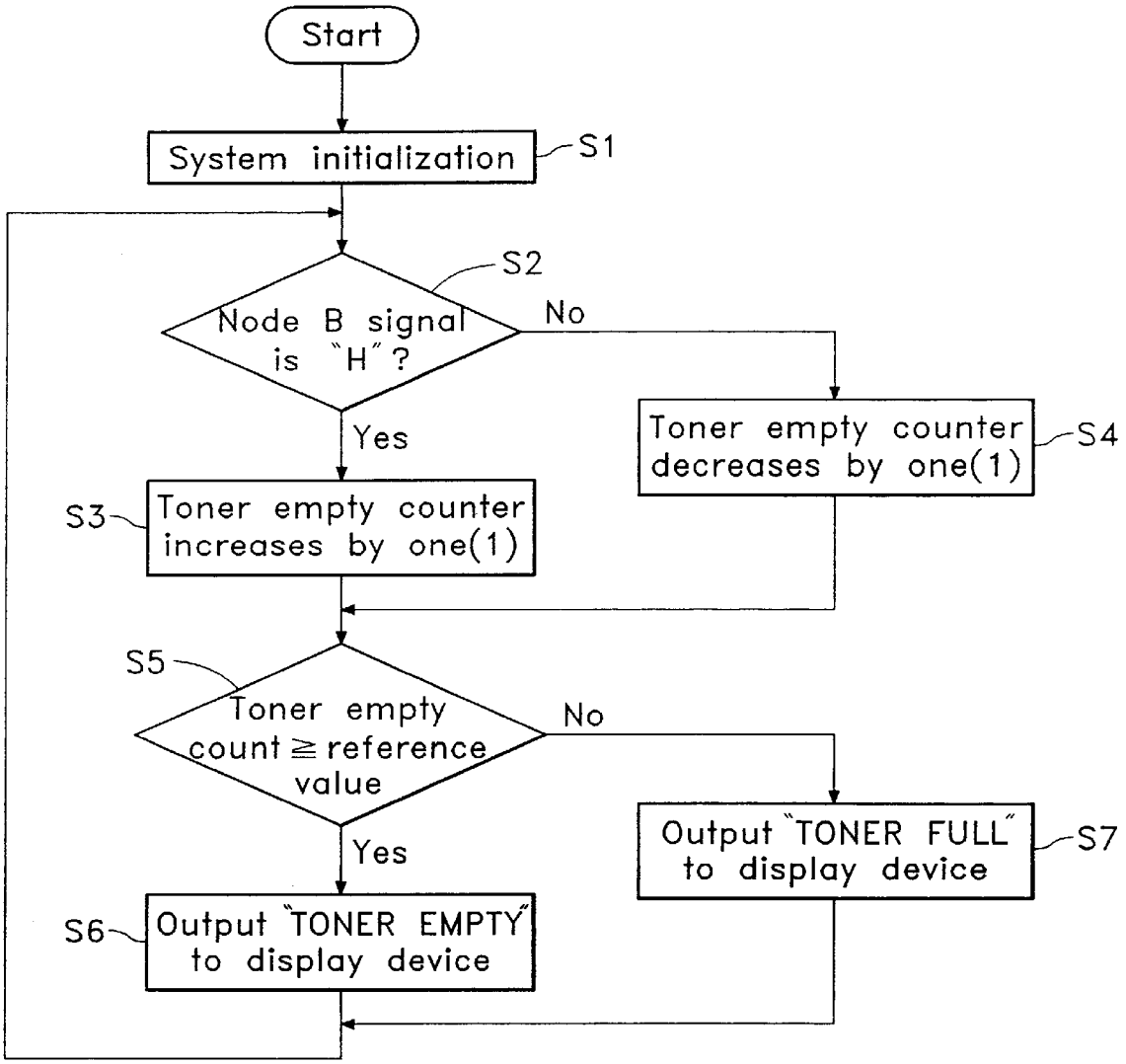
FIG. 3 is a flowchart illustrating a series of steps for detecting the status of toner using a photosensor according to one embodiment of the present invention.

The flowchart of FIG. 3 explains how to detect the status or level of the toner in the developing device. As shown in this flowchart, the printer is initialized when a printer engine is on, an upper and lower limit values of a toner empty counter and a reference value are determined These values give standard points in judging the presence or absence of the toner in toner container in the developing device (S1). After the initialization step, the next step (S2) is followed by judging whether the signal of the last output terminal B of this toner sensing apparatus is low or high. Based on the result of judgment, the next step is performed by counting up the counter values by ones if the output signal is high (S3) and counting down the counting values by ones if low (S4). Then, the status or level of the toner is displayed on any display device as a series of characters "TONER EMPTY" (S6) when the counter value is equal to or larger than the reference value, or as a series of characters "TONER FULL" (S7) when the counter value is smaller than the reference value.

Figure 4:
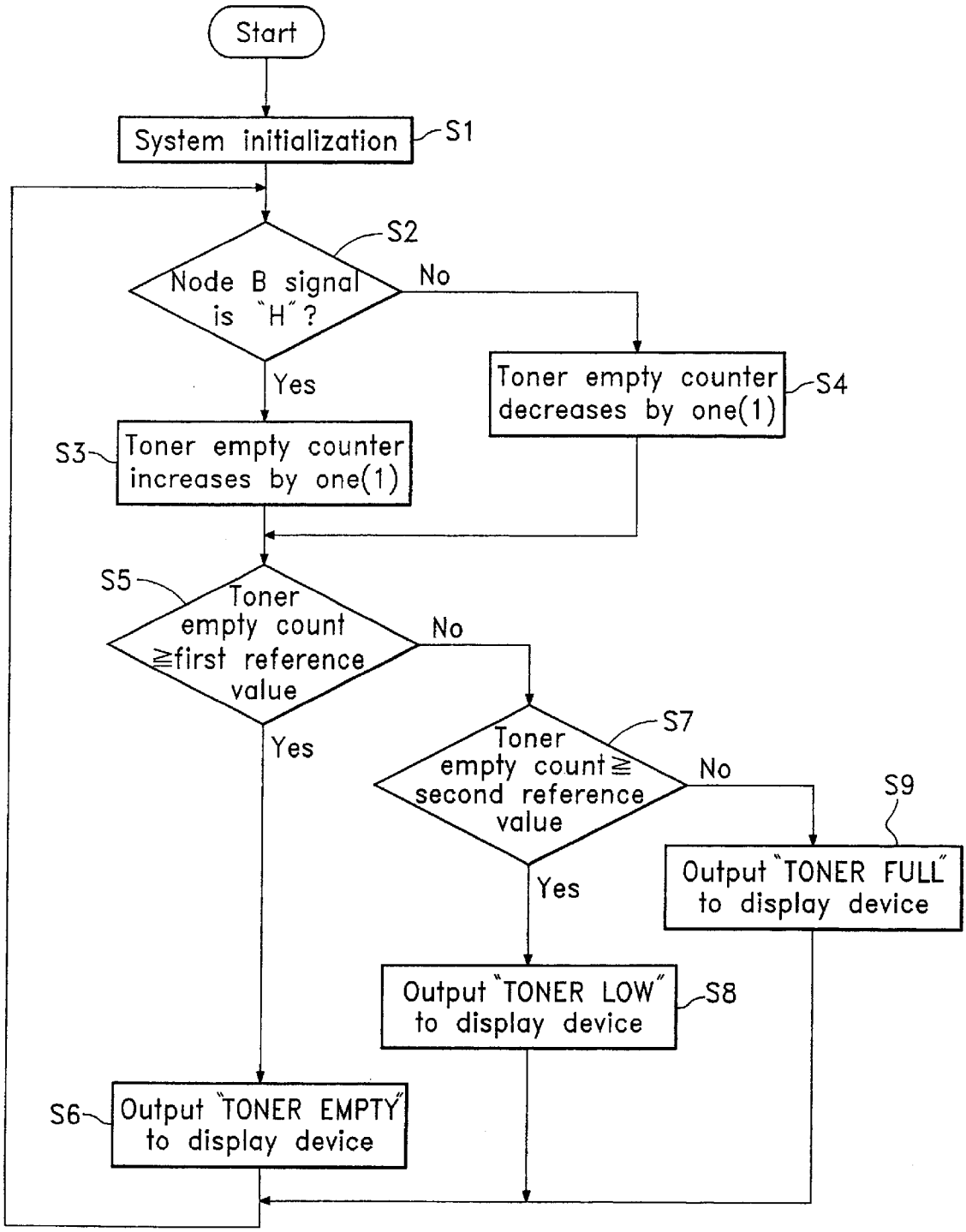
FIG. 4 is a flowchart illustrating a series of steps for detecting the status of toner using a photosensor according to another embodiment of the present invention.

The flow chart of FIG. 4 explains another method according to this invention, wherein the printer is initialized when a printer engine is on. Then, there exists the steps of determining an upper and lower limit values of a toner empty counter and a first reference value and a second reference value which function as standard points in judging the amount of the remaining toner in a toner container in the developing device. After the initialization, the next step is implemented by judging whether the signal of the last output terminal B of this toner sensing apparatus is low or high. Based on the result of judgment, the next step is performed by counting up the counter value by ones if the output signal is high and counting down the counter value by ones if low. Then, comparison of the counter value and the first reference value is implemented and the resultant toner level is displayed on any display device as a series of characters "TONER EMPTY" when the counter value is equal to or larger than the first reference value. However, if the counter value is smaller than the first reference value, an additional comparison is implemented between the counter value and the second reference value and the resultant toner level is displayed on any display device as a series of characters "TONER LOW" when the counter value is equal to or larger than the second reference value, or as a series of characters "TONER FULL" when the counter value is smaller than the second reference value.

The two preceding embodiments of this invention can also be explained as follows referring to FIGS. 2A and 2B illustrating a toner sensing apparatus used with a CPU/counter 28 and a display device 29 in the present invention. At first, as in FIG. 3, the printer is initialized (S1) immediately when a printer engine is on, and at the same time the photodiode 20 emits light since it is connected to the power source Vcc in the forward direction as shown in FIGS. 2A and 2B to allow the current to flow therethrough all the time. Simultaneously, the toner empty counter of CPU/counter 28 is programmed to have the upper limit value and the lower limit value, which is designed to be operated in response to the output from the photosensor, and the reference value which functions as a standard point for judging the presence or absence of the toner in the developing device.

In the absence of the toner in the toner container 23*a* the light from the photodiode 20 is applied to the base of the phototransistor 21 so that the phototransistor 21 is turned off and the last output terminal B of this toner sensing apparatus outputs the signal of high level as shown in FIG. 2D. In contrast if the toner level in toner container 23*a* is properly enough or full, the light transmission from the photodiode 20 to the phototransistor 21 is blocked by the existence of toner, so that the phototransistor 21 is turned on and the last output terminal B of this toner sensing apparatus outputs the signal of low level as shown in FIG. 2C.

Figure 5A:
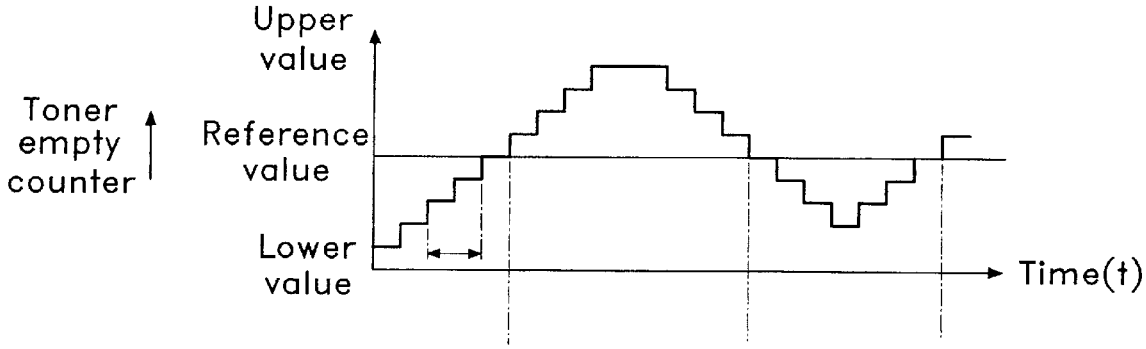
FIG. 5A shows a waveform obtained by sampling the signal of the output terminal B of the toner sensing apparatus of FIG. 2A in accordance with the flowchart of FIG. 3.

Next, the CPU 28 judges whether the output signal of the terminal B is high or low (S2). Based upon the result of judgment, the next step is selected in either of two ways (low or high signal). The high signal signifies what the toner level is short or empty, so that the toner empty counter of CPU/counter 28 increases the counting value by 1 (S3). The low signal signifies that the toner level in the toner container 23*a* is properly enough or full, so that the counter decrease the counting value by 1 (S4). In the steps of S2 to S4, the waveform of FIG. 5A can be obtained by sampling the counter during a specified time T.

Figure 5B:
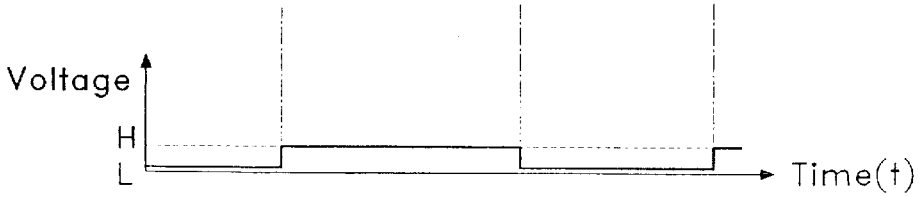
FIG. 5B shows a waveform obtained by filtering the waveform of FIG. 5A using a reference value for a specified duration of time.

After the increase or decrease of the counter value, the resultant value is compared with the reference value (S5). As a result, if the counter value is equal to or larger than the reference value, the high signal is outputted from the terminal B as shown in FIG. 5B and a series of characters "TONER EMPTY" is displayed on the display device 29 to indicate that the toner in toner container 23*a* must be refilled to the user (S6), and however if the counter value is smaller than the reference value, the low signal is outputted from the terminal B as shown in FIG. 5B and a series of characters "TONER FULL" is displayed on the display device 29 to confirm that the toner level in toner container 23*a* is properly enough in the developing device to the user (S7).

Another embodiment of this invention is described below with reference to FIG. 4 again also referring to FIGS. 2A and 2B. In the same manner with the preceding embodiment, the printing system is initialized (S1) immediately when the printer engine is turned on, and at the same time the photodiode 20 emits light since it is connected to the power source Vcc in forward direction as shown in FIGS. 2A and 2B to allow the current to flow therethrough all the time. The toner empty counter of CUP/counter 28 which is designed to perform the counting operation in accordance to the output signal of the photosensor, is programmed to have the upper limit value and lower limit value, the first reference value and the second reference value which both will be standard points in judging the presence or absence of the toner in the developing device.

The light from the photodiode 20 is applied to the base of the phototransistor 21 in the absence of the toner, so that the phototransistor 21 is tuned off and the last output terminal B of this toner sensing apparatus outputs the signal of high level as shown in FIG. 2D. However if the toner in toner container 23*a* is properly enough or full, the light transmission from the photodiode 20 to the phototransistor 21 is blocked by the existence of toner, so that the phototransistor 21 is tuned on and the last output terminal B of this toner sensing apparatus outputs the signal of low level as shown in FIG. 2C.

Figure 6A:
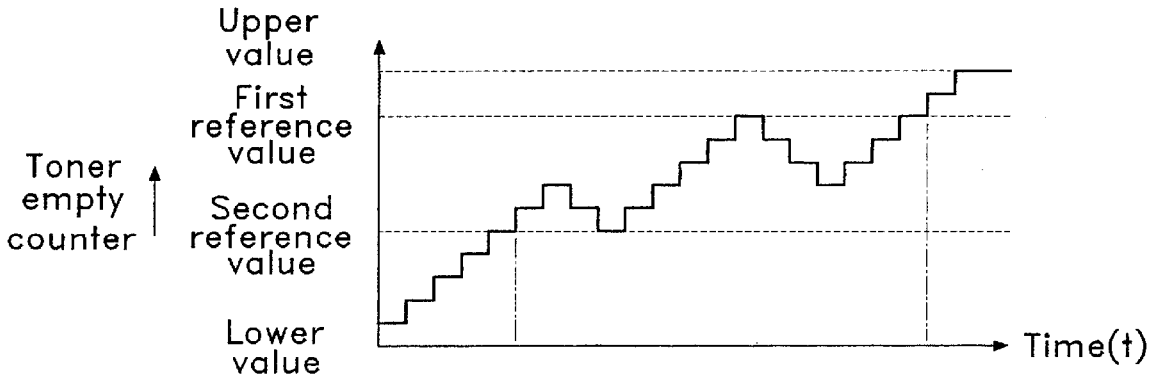
FIG. 6A is a waveform obtained by sampling the signal of the output terminal B of the toner sensing apparatus of FIG. 2A in accordance with the flowchart of FIG. 4.

Then, the CPU 28 judges whether the output signal of the terminal B is high or low (S2). Based upon the result of judgment, the next step is selected in either of two ways. That is, the high signal signifies what the toner level in toner container 23*a* is short or empty, so that the toner empty counter of CPU/conter 28 increases the counting value by 1 (S3), and the low signal signifies that the toner level in toner container 23*a* is properly enough or full, so that the counter decreases the counting value by 1 (S4). In the steps of S2 to S4, the waveform of FIG. 6A can be obtained by sampling the counter during a specified time t.

Figure 6B:
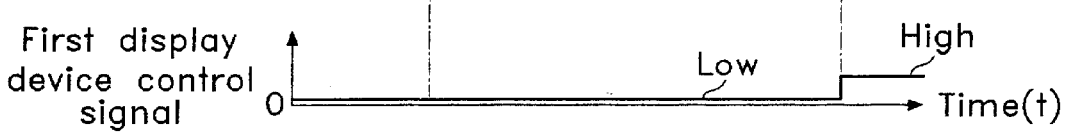
FIG. 6B is a waveform obtained by filtering the waveform of FIG. 6A using a first and a second reference value for a specified duration of time.
Figure 6C:
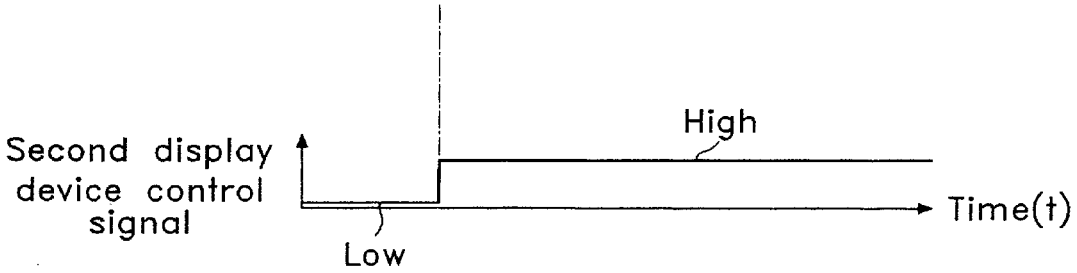
FIG. 6C is a waveform obtained by filtering the waveform of FIG. 6A using a first and second reference value for a specified duration of time.

After such a step (S3 or S4), the counter value is compared with the first reference value (S5) As a result, if the counter value is equal to or larger than the first reference value, a first signal of high level is outputted from the terminal B as shown in FIG. 6B and a series of characters "TONER EMPTY" is displayed on the 29 display device to indicate that the toner in toner container 23*a* must be refilled to the user (S6), and however if the counter value is smaller than the first reference value, that value is again compared with the second reference value (S7). After the comparison of S7, if the counter value is equal to or larger than the second reference value, a first signal of high level and a second signal of low level are outputted from the terminal B as shown in FIGS. 6B and 6C and a series of characters "TONER LOW" is displayed on the 29 display device to indicate that the toner in toner container 23*a* must be refilled before long to the user (S8).

However, if the counter value is smaller than the second reference value, a first signal and a second signal of low level are outputted from the terminal B as shown in FIGS. 6B and a series of characters "TONER FULL" is displayed on the 29 display device to confirm that the toner level in toner container 23*a* is properly enough in the developing device (S9).

As mentioned above, this invention detects the status of the toner in the developing device by means of using a photosensor that can be obtained relatively cheaply. The noise generated from such a photosensor is sampled in accordance with the integral algorithm and is filtered, bringing an improvement in reliability.

It will be recognized by those skilled in the art that changes or modifications can be made to the above-described embodiments without departing from the broad inventive concept of the invention. It should therefore be understood that this invention is not only applicable to the LASER printers described herein but also to page printers, as another example.

What is claimed is:

1. A method for detecting a level of toner powder in a printer, comprising the steps of:

providing a photosensor;

sampling information from said photosensor as to a level of toner powder in a toner container for said printer within a period of time;

when sampling information from said photosensor indicates the level of the toner powder in said toner container as being low, changing a counter value of a counter in accordance with a first algorithm;

when sampling information from said photosensor indicates the level of the toner powder in said toner container as being high, changing the counter value of the counter in accordance with a second algorithm different from the first algorithm;

comparing the counter value with a predetermined reference value; and displaying an indication of the level of the toner powder in said toner container for the printer on a display device dependent upon a comparison of said counter value with said predetermined reference value in said comparing step.

2. The method of claim 1, wherein when said counter value is larger than the predetermined reference value, displaying said indication of the level of the toner powder in said toner container on said display device as a series of characters signifying that the toner container must be refilled.

3. The method of claim 1, wherein when said counter value is not larger than the predetermined reference value, displaying said indication of the level of the toner powder in said toner container on said display device as a series of characters signifying that the toner container need not be refilled.

4. The method of claim 1, wherein said step of sampling information samples information from said photosensor as to a level of toner powder in a toner container for a laser printer.

5. The method of claim 1, wherein when said counter value is larger than the predetermined reference value, displaying said indication of the level of the toner powder in said toner container on said display device as a series of characters signifying that the toner container must be refilled, and wherein when said counter value is not larger than the predetermined reference value, displaying said indication of the level of the toner powder in said toner container on said display device as a series of characters signifying that the toner container need not be refilled.

6. A method for detecting a level of toner powder in a printer, comprising the steps of:

providing a photosensor;

sampling information from said photosensors to a level of toner powder in a toner container for said printer within a period of time;

when sampling information from said photosensor indicates the level of the toner powder in said toner container as being low, changing a counter value of a counter in accordance with a first algorithm;

when sampling information from said photosensor indicates the level of the toner powder in said toner container as being high, changing the counter value of the counter in accordance with a second algorithm different from the first algorithm;

comparing the counter value with at least one of a first predetermined reference value and a second predetermined reference value; and displaying an indication of the level of the toner powder in said toner container for the printer on a display device dependent upon a comparison of said counter value with at least one of said first predetermined reference value and said second predetermined reference value in said comparing step.

7. The method of claim 6, wherein when said counter value is not smaller than the first predetermined reference value, displaying said indication of the level of the toner powder in said toner container on said display device as a series of characters signifying that the toner container is at an empty level and must be refilled.

8. The method of claim 6, wherein when said counter value is not smaller than the second predetermined reference value, displaying said indication of the level of the toner powder in said toner container on said display device as a series of characters signifying that the toner powder in said toner container is at a low level.

9. The method of claim 6, wherein when said counter value is smaller than the first predetermined reference value and is smaller than the second predetermined reference value, displaying said indication of the level of the toner powder in said toner container on said display device as a series of characters signifying that the toner container is filled to a level such that the toner container need not be refilled.

10. The method of claim 6, wherein said step of sampling information samples information from said photosensor as to a level of toner powder in a toner container for a laser printer.

11. The method of claim 6, wherein when said counter value is not smaller than the first predetermined reference value, displaying said indication of the level of the toner powder in said toner container on said display device as a series of characters signifying that the toner container is at an empty level and must be refilled, when said counter value is not smaller than the second predetermined reference value, displaying said indication of the level of the toner powder in said toner container on said display device as a series of characters signifying that the toner powder in said toner container is at a low level, and when said counter value is smaller than the first predetermined reference value and is smaller than the second predetermined reference value, displaying said indication of the level of the toner powder in said toner container on said display device as a series of characters signifying that the toner container is filled to a level such that the toner container need not be refilled.

12. An apparatus for detecting a level of toner powder in a printer, the apparatus comprising:

a photosensor;

means for sampling information from said photosensor as to a level of toner powder in a toner container for said printer;

means for changing a counter value of a counter in accordance with a first algorithm when sampling information from said photosensor received by said means for sampling indicates the level of the toner powder in said toner container as being low;

means for changing the counter value of the counter in accordance with a second algorithm different from the first algorithm when sampling information from said photosensor received by said means for sampling indicates the level of the toner powder in said toner container as being high;

means for comparing the counter value with a predetermined reference value; and a display device for displaying an indication of the level of the toner powder in said toner container for the printer dependent upon an outcome of comparing the counter value with the predetermined reference value by said means for comparing.

13. The apparatus of claim 12, wherein when said counter value is larger than the predetermined reference value, said indication of the level of the toner powder in said toner container is displayed on said display device as a series of characters signifying that the toner container must be refilled.

14. The apparatus of claim 12, wherein when said counter value is not larger than the predetermined reference value, said indication of the level of the tone powder in said toner container is displayed on said display device as a series of characters signifying that the toner container need not be refilled.

15. The apparatus of claim 12, wherein said printer comprises a laser printer.

16. The apparatus of claim 12, wherein when said counter value is larger than the predetermined reference value, said indication of the level of the toner powder in said toner container is displayed on said display device as a series of characters signifying that the toner container must be refilled, and wherein when said counter value is not larger than the predetermined reference value, said indication of the level of the toner powder in said toner container is displayed on said display device as a series of characters signifying that the toner container need not be refilled.

17. An apparatus for detecting a level of toner powder in a printer, the apparatus comprising:

a photosensor;

means for sampling information from said photosensor as to a level of toner powder in a toner container for said printer;

means for changing a counter value of a counter in accordance with a first algorithm when sampling information from said photosensor received by said means for sampling indicates the level of the toner powder in said toner container as being low;

means for changing the counter value of the counter in accordance with a second algorithm different from the first algorithm when sampling information from said photosensor received by said means for sampling indicates the level of the toner powder in said toner container as being high;

means for comparing the counter value with at least one of a first predetermined reference value and a second predetermined reference value; and a display device for displaying an indication of the level of the toner powder in said toner container for the printer dependent upon an outcome of comparing the counter value with at least one of said first predetermined reference value and said second predetermined reference value by said means for comparing.

18. The apparatus of claim 17, wherein when said counter value is not smaller than the first predetermined reference value, said indication of the level of the toner powder in said toner container is displayed on said display device as a series of characters signifying that the toner container is at an empty level and must be refilled.

19. The apparatus of claim 17, wherein when said counter value is not smaller than the second predetermined reference value, said indication of the level of the toner powder in said toner container is displayed on said display device as a series of characters signifying that the toner powder in said toner container is at a low level.

20. The apparatus of claim 17, wherein when said counter value is smaller than the first predetermined reference value and is smaller than the second predetermined reference value, said indication of the level of the toner powder in said toner container is displayed on said display device as a series of characters signifying that the toner container is filled to a level such that the toner container need not be refilled.

21. The apparatus of claim 17, wherein said printer comprises a laser printer. the predetermined reference value, displaying said indication of the level of the toner powder in said toner container on said display device as a series of characters signifying that the toner container must be refilled.

22. The apparatus of claim 17, wherein when said counter value is not smaller than the first predetermined reference value, said indication of the level of the toner powder in said toner container is displayed on said display device as a series of characters signifying that the toner container is at an empty level and must be refilled, when said counter value is not smaller than the second predetermined reference value, said indication of the level of the toner powder in said toner container is displayed on said display device as a series of characters signifying that the toner powder in said toner container is at a low level, and when said counter value is smaller than the first predetermined reference value and is smaller than the second predetermined reference value, said indication of the level of the toner powder in said toner container is displayed on said display device as a series of characters signifying that the toner container is filled to a level such that the toner container need not be refilled.

* * * * *